US007359519B2

(12) United States Patent
Lee et al.

(10) Patent No.: US 7,359,519 B2
(45) Date of Patent: Apr. 15, 2008

(54) METHOD AND APPARATUS FOR COMPENSATING FOR NONLINEAR DISTORTION OF SPEAKER SYSTEM

(75) Inventors: Joon-hyun Lee, Seongnam-si (KR); Seong-cheol Jang, Seongnami-si (KR)

(73) Assignee: Samsung Electronics Co., Ltd., Suwon (KR)

( * ) Notice: Subject to any disclaimer, the term of this patent is extended or adjusted under 35 U.S.C. 154(b) by 358 days.

(21) Appl. No.: 10/932,258

(22) Filed: Sep. 2, 2004

(65) Prior Publication Data

US 2005/0047606 A1 Mar. 3, 2005

(30) Foreign Application Priority Data

Sep. 3, 2003 (KR) ..... 10-2003-0061371

(51) Int. Cl.
*H04R 29/00* (2006.01)

(52) U.S. Cl. ..... 381/59; 381/96; 381/98

(58) Field of Classification Search ..... 381/1–124
See application file for complete search history.

(56) References Cited

U.S. PATENT DOCUMENTS 5,438,625 A 8/1995 Klippel
5,528,695 A * 6/1996 Klippel ..... 381/55
5,694,476 A * 12/1997 Klippel ..... 381/96
5,815,585 A * 9/1998 Klippel ..... 381/96
6,058,195 A * 5/2000 Klippel ..... 381/96
6,408,079 B1 * 6/2002 Katayama et al. ..... 381/98
6,760,451 B1 * 7/2004 Craven et al. ..... 381/98
7,016,833 B2 * 3/2006 Gable et al. ..... 704/209
2001/0031053 A1 * 10/2001 Feng et al. ..... 381/92
2005/0031140 A1 * 2/2005 Browning ..... 381/96

FOREIGN PATENT DOCUMENTS

JP 10-322205 A 12/1998
KR 2001-0066282 A 7/2001

* cited by examiner

*Primary Examiner*—Vivian Chin
*Assistant Examiner*—Disler Paul
(74) *Attorney, Agent, or Firm*—Sughrue Mion, PLLC

(57) ABSTRACT

A method and an apparatus for compensating for nonlinear distortion are provided to divide audio signals reproduced in a nonlinear speaker system into linear and nonlinear components in a time domain and a frequency domain, and then generate inversely-corrected signals by means of an inverse filtering scheme, so that it is possible to further consider a variety of nonlinear distortion characteristics such as viscous damping and structural damping which have not been reflected in the conventional lumped parameter method, and thus to obtain better sound quality.

20 Claims, 4 Drawing Sheets

METHOD AND APPARATUS FOR COMPENSATING FOR NONLINEAR DISTORTION OF SPEAKER SYSTEM

BACKGROUND OF THE INVENTION

This application claims the priority of Korean Patent Application No. 2003-61371, filed on Sep. 3, 2003, in the Korean Intellectual Property Office, the disclosure of which is incorporated herein in its entirety by reference.

1. Field of the Invention

The present invention relates to a method of and an apparatus for compensating for nonlinear distortion, and more particularly to, a method of and an apparatus for compensating for nonlinear distortion for dividing audio signals reproduced in a nonlinear speaker system into linear and nonlinear components in a time domain and a frequency domain, and then generating inversely-corrected signals by means of an inverse filtering scheme.

2. Description of the Related Art

A variety of audio/video (AV) devices such as television sets and audio record players generate audio signals as their final outputs. The audio signals are usually generated by a speaker which converts electrical audio signals into sound pressure waves. A speaker system usually comprises voice coils, a magnet unit surrounded by the voice coils, and a diaphragm which produce physical signals propagating through space from the electrical signals. However, the diaphragm installed in the speaker system does not produce its displacement X in linear proportion to the amplitude of an input signal due to its inherent physical properties. This is because the stiffness of the diaphragm is not linearly proportional to the displacement of the diaphragm. Therefore, the sound pressure waves output according to the nonlinearity contain nonlinear components, which will cause degradation of the sound quality of a variety of audio outputs.

FIG. 1 shows a conventional method for reducing nonlinear distortion.

The input signal Ugl is a signal subjected to a Fourier frequency transform, and is input to a displacement filter 101. The displacement filter 101 has the displacement of vibration as a frequency function, whereby the stiffness $k_2$ can be calculated. Such parameter information for the displacement filter 101 is usually available from a table previously provided by the speaker manufacturer. If the stiffness $k_2$ and the corresponding displacement x are determined, the function $f(k,x)=k_2x^3$ can be calculated, and the resulting signal and the input signal Ugl are summed in an adder 103 to generate an inversely-corrected signal Ugn which is input as a final signal to the speaker.

According to the conventional method described above, since the speaker system is modeled by using the lumped parameter method, the applicable frequency band is limited to the range of 500 Hz or less in which the wavelength is larger than the size of the speaker, and thus it is impossible to analyze any nonlinear distortion in the range of 500 Hz or more. Considering that second and third harmonic components which are nonlinear components critically degrading sound quality are generated in the range of 500 Hz or more, the lumped parameter method is not appropriate for nonlinear distortion analysis even if the frequency band of the audio signal is 500 Hz or less.

In the conventional method, the mass M, the stiffness $k_0$, and the viscous damping coefficient R are used to represent the speaker system, and nonlinear stiffness and force factors are assumed as those causing nonlinear characteristics to obtain the equation of nonlinear motion. However, there are various other factors that can actually cause nonlinearity of the speaker system, such as nonlinear viscous damping and structural damping. Furthermore, in the conventional method, the hysteresis phenomenon based on a time history cannot be considered.

In addition, in the conventional method, it is necessary to measure the nonlinear distortion caused by the displacement x of the speaker itself. This actually requires special equipment, thereby causing many difficulties in implementation. Furthermore, it is impossible to reflect phase information of the input signal corresponding to its frequency.

SUMMARY OF THE INVENTION

The present invention provides a method of compensating for nonlinear distortion, capable of improving quality of an output signal by considering factors such as harmonic distortion, viscous damping, structural damping, and the hysteresis phenomenon, which have not been considered in the conventional lumped parameter method.

The present invention also provides a method for compensating for nonlinear distortion, capable of being easily implemented and having no need to measure a displacement of a speaker diaphragm.

The present invention further provides a method for compensating for nonlinear distortion, capable of further improving quality of an output signal by considering more factors which cause nonlinearity of a speaker.

According to an aspect of the present invention, there is provided a method of compensating for nonlinear distortion of a speaker system in a frequency domain, the method comprising: (a) receiving an audio signal from an audio source and converting the audio signal into a frequency domain signal; (b) pre-correcting the frequency domain signal by using a linear frequency characteristic and a total frequency characteristic of the speaker system; and (c) converting the pre-corrected signal into a time domain signal to generate the time domain signal of the audio signal. Operation (b) may be performed by using a transfer function: $Mf(w)=[2HL(w)-HT(w)]/HL(w)$, where HL(w) is the linear frequency characteristic of the speaker system; and HT(w) is the total frequency characteristic of the speaker system.

In this case, the linear frequency characteristic HL(w) of the speaker system may be generated by an ARX modeling or an ARMAX modeling.

Also, the total frequency characteristic HT(w) of the speaker system may be generated by using a nonlinear response measurement.

According to another aspect of the present invention, there is provided a method of compensating for nonlinear distortion of a speaker system in a time domain, the method comprising (a) pre-correcting an audio signal from an audio source by using a linear time domain characteristic and a nonlinear time domain characteristic of the speaker system; and (b) converting the pre-corrected signal into an analog signal. Operation (a) may be performed by using a transfer function: $Mt(t)=GL(q)/[GL(q)+GNL(q)]$, where GL(q) is the linear time domain characteristic of the speaker system; GNL(q) is the nonlinear time domain characteristic of the speaker system; and q is a delay operator.

In this case, the linear time domain characteristic GL(q) may be generated by an ARX modeling or an ARMAX modeling, and the nonlinear time domain characteristic GNL(q) may be generated by a nonlinear response measurement.

According to a further aspect of the present invention, there is provided an apparatus for compensating for nonlinear distortion of a speaker system, the apparatus comprising: a frequency domain converter which receives an audio signal from an audio source and converts the audio signal into a frequency domain signal; a pre-corrector which pre-corrects the frequency domain signal by using a linear frequency characteristic and a nonlinear frequency characteristic of the speaker system; and a time domain converter which converts the pre-correcting signal into a time domain signal to generate the time domain signal of the audio signal.

A transfer function M(w) of the pre-corrector may be generated by using an equation: Mf(w)=[2HL(w)−HT(w)]/HL(w), where HL(w) is the linear frequency characteristic of the speaker system; and HT(w) is the total frequency characteristic of the speaker system.

According to an even further aspect of the present invention, there is provided an apparatus for compensating for nonlinear distortion of a speaker system in a time domain, the apparatus comprising: a time domain pre-corrector which pre-corrects an audio signal from an audio source by using a linear time domain characteristic and a nonlinear time domain characteristic of the speaker system; and a digital-to-analog converter which converts the pre-corrected signal into an analog signal. A transfer function of the time domain pre-corrector may be generated by using an equation: Mt(t)=GL(q)/[GL(q)+GNL(q)], where GL(q) is the linear time domain characteristic of the speaker system; GNL(q) is the nonlinear time domain characteristic of the speaker system; and q is a delay operator.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Figure 1:
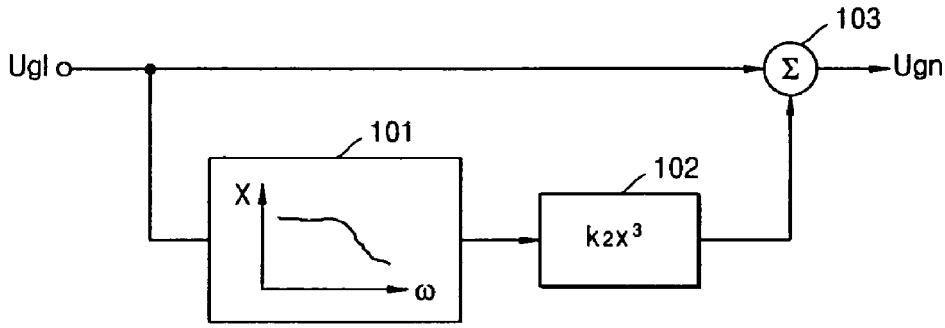
FIG. 1 (PRIOR ART)
FIG. 1 shows a conceptual diagram illustrating a conventional apparatus for reducing nonlinear distortion.

To fully understand the advantages of the present invention and operation thereof and objects to be attained by embodiments of the present invention, the accompanying drawings illustrating an exemplary embodiment of the present invention and the contents described in the accompanying drawings should be referred to.

Hereinafter, an exemplary embodiment of the present invention will be described with reference to the accompanying drawings to explain the present invention in detail. The same elements in the drawings are indicated by the same reference numerals.

A method and an apparatus for compensating for nonlinear distortion according to the present invention can be classified in terms of a frequency domain pre-correction and time domain pre-correction depending on a pre-correction method.

Frequency Domain Pre-correction

Figure 2:
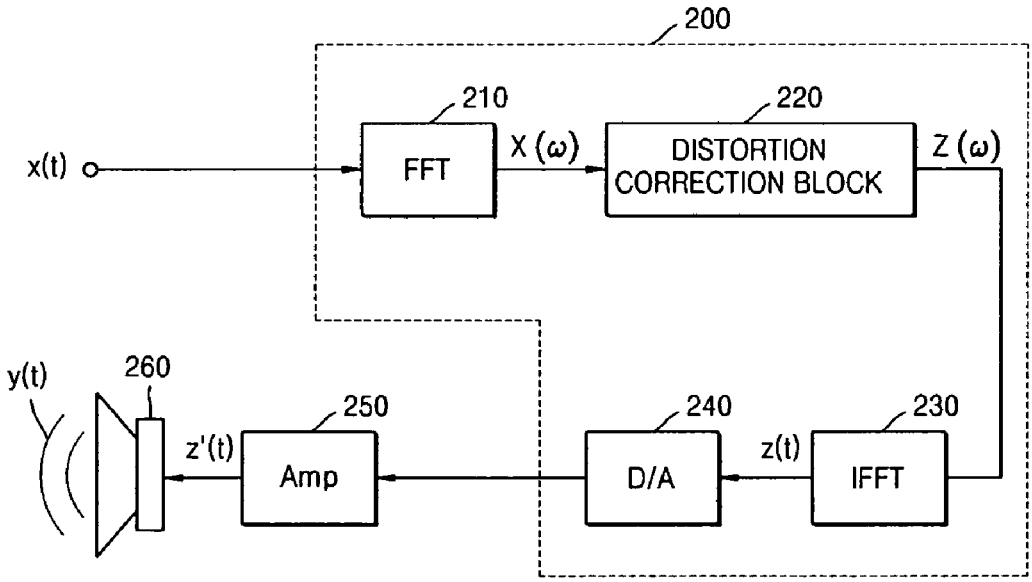
FIG. 2 is a block diagram illustrating a nonlinear distortion compensator according to an embodiment of the present invention.

FIG. 2 is a block diagram illustrating a nonlinear distortion compensator according to an embodiment of the present invention.

The nonlinear distortion compensator 200 according to the present invention comprises a frequency domain converter 210 using a fast Fourier transform (FFT), a pre-corrector 220, a time domain converter 230, and a digital-to-analog converter 240. In this embodiment, the pre-correction is performed on frequency domain signals.

It is assumed that the speaker system 260 has a linear frequency response HL(w) and a total frequency response Ht(w) including a nonlinear frequency response.

An audio signal x(t) from an audio source (not shown) is converted into a frequency domain signal by the frequency domain converter 210. A frequency domain conversion is a mathematical representation for converting variables in a time domain into a frequency domain. In terms of hardware, it is possible to implement a variety of converter models which can mathematically express frequency-converted waveforms and conversion coefficients after the frequency conversion. For this embodiment, a fast Fourier transform is used. The frequency-converted signal X(w) has an amplitude function for each frequency. The frequency-converted signal X(w) is also converted into a new version of input signal which is pre-corrected by the pre-coffector 220 so that a final output y(t) can have only linear components.

The new version of input signal Z(w) is further converted into a time domain signal z(t) by the time domain converter 230 using an inverse fast Fourier transform (IFFT), and then the time domain signal z(t) is further converted into an analog signal by the digital-to-analog converter (D/A) 240. Subsequently, the analog signal from the D/A 240 is amplified by the amplifier (Amp) 250, and then input to the speaker system 260. Finally, the speaker 260 outputs a new version of output signal y(t) which has only linear components.

Now, how to generate a transfer function of the pre-corrector 220 in a frequency domain will be described.

Typically, audio signals to be reproduced are composed of linear components and nonlinear components. The nonlinear components are distortion components generated from inherent nonlinearity of the speaker system. Therefore, a nonlinear model for a typical speaker system can be represented as follows:

$$\begin{aligned} Yt(w) &= Ht(w)X(w) \\ &= YL(w) + YNL(w) \\ &= HL(w)X(w) + YNL(w), \end{aligned} \quad \text{[Equation 1]}$$

where Yt(w) is a total frequency response of a speaker output signal;

Ht(w) is a total transfer function of the speaker system;

X(w) is a frequency domain representation of an input signal x(t);

YL(w) is a linear frequency response of a speaker output signal;

YNL(w) is a nonlinear frequency response of a speaker output signal; and

HL(w) is a linear transfer function of the speaker system.

As described above, the present invention obtains a speaker input signal which makes it possible to output no nonlinear distortion components. Therefore, the total output signal from the speaker 260 will include only linear components if the pre-corrected signal is input to the speaker 260. As a consequence, YL(w) can be represented as follows;

$$YL(w)=HL(w)Z(w)+YNL(w), \quad \text{[Equation 2]}$$

where Z(w) is a pre-corrected input signal.

Meanwhile, referring to Equation 1, the nonlinear frequency response of a speaker output YNL(w) can be represented as follows:

$$YNL(w)=[Ht(w)-HL(w)]X(w). \quad \text{[Equation 3]}$$

By referring to Equation 2 and Equation 3, Equation 4 will be obtained as follows.

$$\begin{aligned} YL(w) &= HL(w)Z(w) + YNL(w) \quad \text{[Equation 4]} \\ \therefore Z(w) &= [YL(w) - YNL(w)] / HL(w) \\ &= [HL(w)X(w) - YNL(w)] / HL(w) \\ &= [HL(w)X(w) - [Ht(w) - HL(w)]X(w)] / HL(w) \\ &= [[2HL(w) - Ht(w)] / HL(w)]X(w) \end{aligned}$$

As a consequence, a frequency domain transfer function Mf(w) of the pre-corrector 220 would be [2HL(w)−Ht(w)]/HL(w)] in order for the speaker 260 to output only linear components. In other words, the frequency domain transfer function of the pre-corrector 220 can be determined by identifying the linear transfer function HL(w) and the total transfer function Ht(w) of the speaker system.

For example, the linear transfer function HL(w) of the speaker system can be identified by a system identification such as an AutoRegressive with eXogeneous input (ARX) modeling or an AutoRegressive Moving Average with eXogeneous input (ARMAX) modeling.

The total transfer function Ht(w) including inherent nonlinearity of the speaker system can be identified by a nonlinear response measurement For a linear response measurement, a maximum length sequence, peak noise, and white noise are used as an input signal. Meanwhile, for a nonlinear response measurement, a sine sweep signal is used as an input signal because a certain period of time is needed to sufficiently develop nonlinear components. In other words, the measurement is performed by using a sine signal having an audio frequency of 20 Hz to 20 Khz as an input signal. Also, purified sine tones are input according to an interval of 10 Hz or of any desired resolution. The output signal from the speaker is measured by using, for example, a microphone to obtain an output-to-input ratio. The microphone may be a highly sensitive one such as a B&K microphone. The measurement of output-to-input ratios is performed for the whole frequency range. Finally, the results for the entire frequency ranges are summed to identify the frequency characteristic for the whole frequency range.

In addition, for a linear system, a frequency characteristic does not depend on the amplitude of an input signal. Meanwhile, for a nonlinear system, a frequency characteristic depends on the amplitude of an input signal. For this reason, incorrect frequency or time characteristics would be obtained if a nonlinear system uses the signal which has been used in a frequency response analysis of a linear system as an input signal. Also, the nonlinear system should use a varying input signal, and the sine sweep set up for each level should be used to measure its nonlinear frequency characteristic for each level. Considering that an audible sound pressure level in a typical speaker system is between 60 and 80 dB, a nonlinear frequency characteristic measured at 80 dB or 60 dB can be regarded as a representative nonlinear frequency characteristic of the speaker system to be measured. This is because the nonlinear frequency characteristics are not significantly changed in the range between 60 to 80 dB.

The linear modeling and the nonlinear response measurement described above are well known to those skilled in the art.

As a consequence, the pre-corrector 220 can be implemented by using an FIR filter, an IIR filter, or the like if its transfer function is determined.

Time Domain Pre-correction

Figure 3:
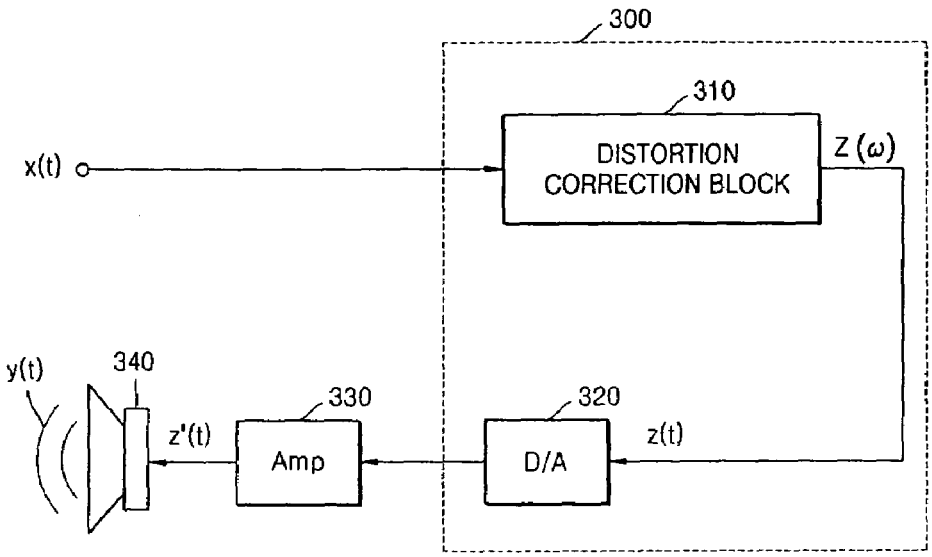
FIG. 3 is a block diagram illustrating a nonlinear distortion compensator according to another embodiment of the present invention.

FIG. 3 is a block diagram illustrating a nonlinear distortion compensator according to another embodiment of the present invention.

A nonlinear distortion compensator 300 according to this embodiment comprises a time-domain pre-corrector 310 and a digital-to-analog converter (D/A) 320. In this embodiment, the pre-correction is directly performed in a time domain without conversion into a frequency domain. Therefore, the pre-corrector 310 has a transfer function in a time domain.

Similarly to the nonlinear frequency domain model, a nonlinear time-domain model has the output audio signal classified into nonlinear components and linear components. The output signal yt(t) can be represented as follows:

$$\begin{aligned} Yt(t) &= [GL(q) + GNL(q)]x(t) + [JL(q) + JNL(q)]e(t) \quad \text{[Equation 5]} \\ &= [GL(q)x(t) + JL(q)e(t)]_{linear} + \\ &\quad [GNL(q)x(t) + JNL(q)e(t)]_{nonlinear} \\ &= YL(t) + YNL(t), \end{aligned}$$

where Yt(t) is a total speaker output signal in a time domain; GL(q) is a linear transfer function of the speaker system in a time domain; GNL(q) is a nonlinear transfer function of the speaker system in a time domain; e(t) is an error signal; JL(q) is a linear disturbance function by the error signal; JNL(q) is a nonlinear disturbance function by the error signal; q is a delay operator; YL(t) is a linear speaker output signal in a time domain; and YNL(t) is a nonlinear speaker output signal in a time domain.

Supposing a new version of input signal z(t) is input to the speaker system, and the input signal z(t) produces only speaker output signals with no nonlinear component, Equation 5 can be modified as follows:

$$YL(t)=[GL(q)+GNL(q)]z(t)+[JL(q)+JNL(q)]e(t). \quad \text{[Equation 5]}$$

By referring to Equation 5 and Equation 6, the pre-corrected version of the input signal z(t) can be represented as follows:

$$z(t) = [GL(q)x(t) - JNL(q)e(t)] / [GL(q) + GNL(q)] \quad \text{[Equation 7]}$$

-continued $$= GL(q)x(t)/[GL(q)+GNL(q)] - JNL(q)e(t)/[GL(q)+GNL(q)]$$

$$= Mt(t)x(t) - Me(t)e(t);$$

where, Mt(t) is a transfer function of the pre-corrector 300 in a time domain; and Me(t) is a transfer function of an error signal in a time domain. Typically, an influence of the error signal caused by an external environment can be neglected with respect to the nonlinear distortion. Therefore, the Equation 7 can be simplified as follows:

$$z(t) = Mt(t)x(t) \quad \text{[Equation 8]}$$

$$= [GL(q)/[GL(q)+GNL(q)]]x(t).$$

As a consequence, a transfer function of the pre-corrector 300 can be simplified into Mt(t)=GL(q)/[GL(q)+GNL(q)] in a time domain. In other words, the transfer function of the pre-corrector 300 can be determined by identifying the linear transfer function GL(q) and the nonlinear transfer function GNL(q) of the speaker system in a time domain.

Similarly to the case of the frequency domain described above, the linear transfer function GL(q) and the nonlinear transfer function GNL(q) of the speaker system in a time domain can be identified through a system identification such as an ARX or an ARMAX modeling, and the nonlinear response measurement. As described above, since such methods are well known to those skilled in the art, the detailed descriptions will not be given.

The pre-corrector 220 can be implemented by using an FIR filter, an IIR filter, or the like if its transfer function is obtained.

Figure 4A:
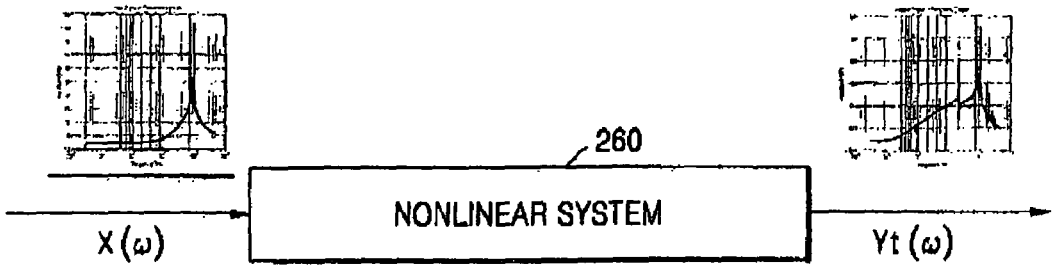
FIG. 4A shows input and output signals of a speaker system when the nonlinear distortion compensator according to the present invention is not provided.
Figure 4B:
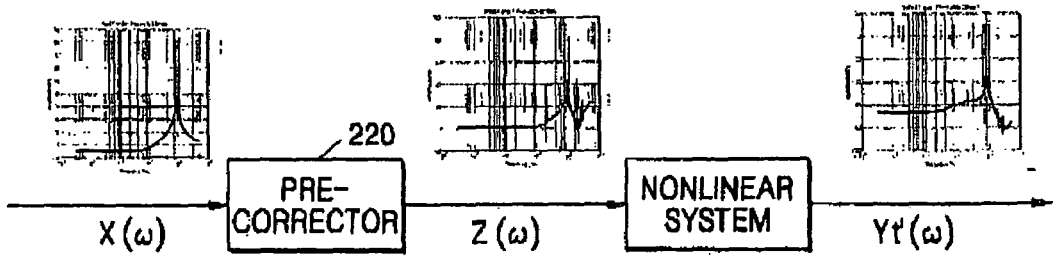
FIG. 4B shows input and output signals of the speaker system when the nonlinear distortion compensator according to the present invention is provided.

FIG. 4A shows input and output signals of the speaker system 260 or 340 when the nonlinear distortion compensator 200 or 300 according to the present invention is not provided. FIG. 4B shows input and output signals of the speaker system 260 or 340 when the nonlinear distortion compensator 200 or 300 according to the present invention is provided.

In FIG. 4A, the nonlinear speaker system 260 receives the input signal X(w) and outputs the signal Yt(w) including distorted components. The output signal Yt(w) includes distorted signal components caused by harmonics.

Meanwhile, in FIG. 4B where a distortion compensator 200 is provided, the pre-corrector 220 of the nonlinear distortion compensator 200 is arranged just before the nonlinear speaker system 260. The input signal to the speaker system 260 is not an input signal X(w) from the audio source but a new version of input signal Z(w) through the pre-corrector 220. The new version of input signal Z(w) which has been pre-corrected also has a distorted waveform as shown in the drawing. However, when the distorted signal Z(w) is applied to the speaker system 260, its final output signal Yt'(w) does not have the distorted components but linear components because nonlinear components have been removed.

Figure 5:
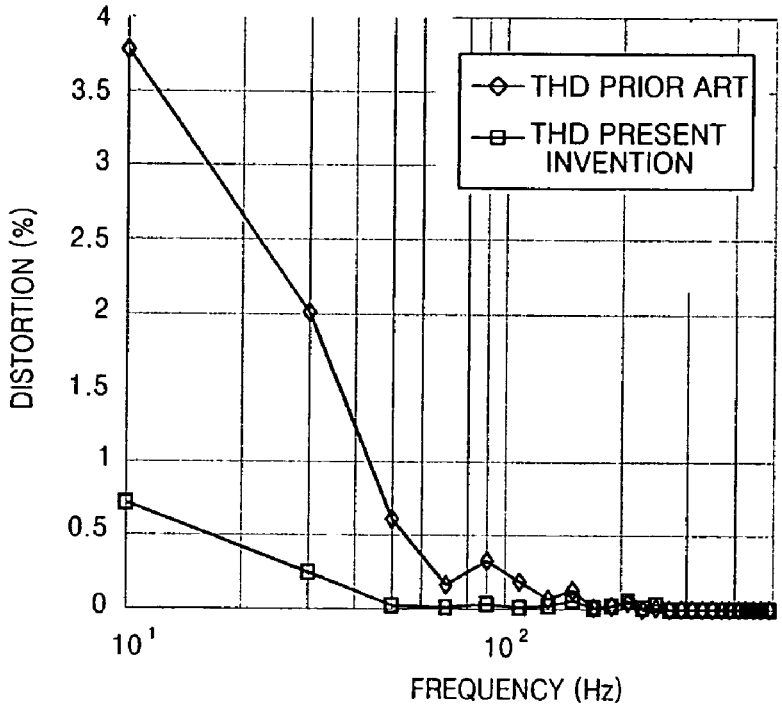
FIG. 5 shows total harmonic distortion (THD) factors for a test signal according to the present method and the conventional method.

FIG. 5 shows total harmonic distortion (THD) factors for a test signal according to the present method and the conventional method.

As shown in the drawing, it would be recognized that the harmonic distortion is significantly reduced by using the pre-corrector according to the present invention. Particularly, such an effect can be remarkable in a frequency of 100 Hz or less. For example, when the frequency of an audio signal was set to 10 Hz, the distortion factor was reduced from 3.76% to 0.7%.

Figure 6:
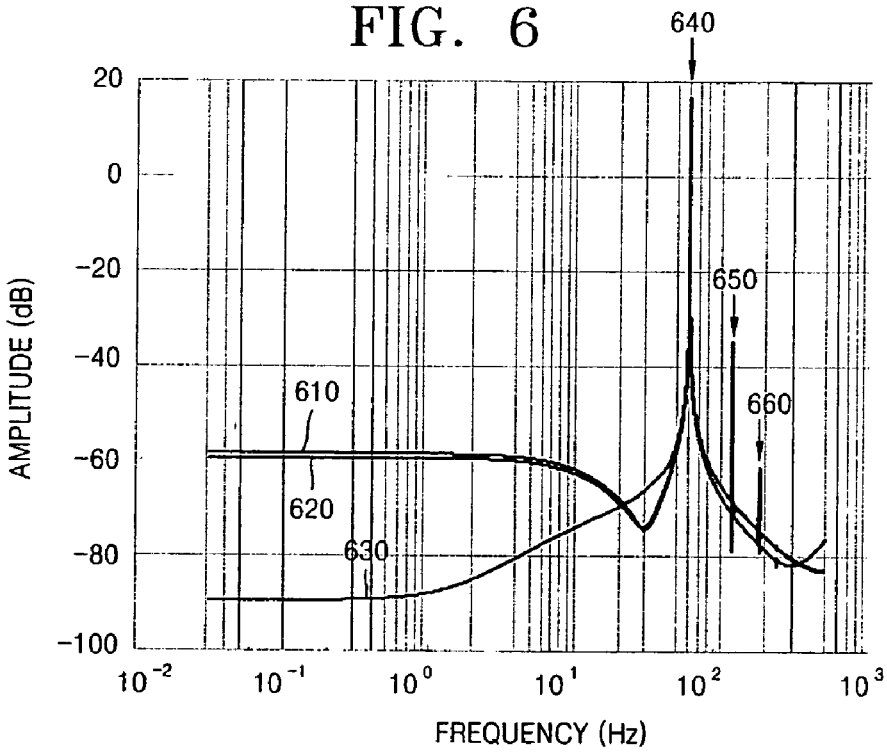
FIG. 6 shows input/output relations of the speaker system.

FIG. 6 shows input/output relations of the speaker system. A nonlinear signal output 610 corresponds to the output signal Yt(w) when the audio signal X(w) is directly applied to the speaker system without the pre-correction. A pre-corrected signal output 630 corresponds to a new version of input signal Z(w) through the pre-corrector 220. A linear signal output 620 corresponds to the output signal Yt'(w) when the new version of input signal Z(w) is input to the speaker system.

As shown in FIG. 6, the nonlinear signal output 610 includes distorted portions 650 and 660 caused by second and third harmonics as well as a portion 640 corresponding to the desired signal output. However, it would be recognized that in the linear signal output 620 through the pre-corrector 220, distorted portions caused by such harmonics are remarkably reduced.

As described above, according to the present invention, it is possible to consider a variety of nonlinear distortion characteristics such as viscous damping and structural damping which have not been reflected in the conventional lumped parameter method, thereby obtaining better sound quality.

In addition, according to the present invention, it is possible to compensate for the distortion caused by second or third harmonics which function as the nonlinear factors that critically degrade the sound quality.

Furthermore, according to the present invention, it is not necessary to measure the displacement of the speaker diaphragm, thereby facilitating implementation of the distortion compensator.

Furthermore, according to the present invention, it is possible to consider information of phase shifts and hysteresis phenomenon based on the time history of audio signal frequencies, thereby obtaining better sound quality Exemplary embodiments of the present invention are disclosed in the drawings and the specification, as described above. In addition, although specific terms have been used hereto, the terms are intended to explain the present invention, but not intended to limit a meaning or restrict the scope of the present invention written in the following claims. Accordingly, it will be understood by those of ordinary skill in the art that various changes in form and details may be made therein without departing from the spirit and scope of the present invention as defined by the following claims.

What is claimed is:

1. A method of compensating for nonlinear distortion of a speakers system in a frequency domain, the method comprising:

(a) receiving an audio signal from an audio source and converting the audio signal into a frequency domain signal;

(b) pre-correcting the frequency domain signal by using a linear frequency characteristic and a total frequency characteristic of the speaker system; and (c) converting the pre-corrected signal into a time domain signal to generate the time domain signal of the audio signal, wherein (b) is performed by using a transfer function:

$$Mf(w)=[2HL(w)-HT(w)]/HL(w),$$

where HL(w) is the linear frequency characteristic of the speaker system; and HT(w) is the total frequency characteristic of the speaker system.

2. The method according to claim 1, wherein the linear frequency characteristic HL(w) of the speaker system is generated by an ARX modeling or an ARMAX modeling.

3. The method according to claim 1, wherein the total frequency characteristic HT(w) of the speaker system is generated by using a nonlinear response measurement.

4. The method according to claim 1, further comprising (d) converting the time domain signal into an analog signal.

5. The method according to claim 1, wherein in (a), the audio signal is converted into the frequency domain signal by using a fast Fourier transform, and in (c), the pre-corrected signal is converted into the time domain signal by using an inverse fast Fourier transform.

6. The method according to claim 1, wherein in (b) the frequency domain signal is pre-corrected by using a finite impulse response (FIR) filter.

7. A method of compensating for nonlinear distortion of a speakers system in a time domain, the method comprising:

(a) pre-correcting an audio signal from an audio source by using a linear time domain characteristic and a nonlinear time domain characteristic of the speaker system; and (b) converting the pre-corrected signal into an analog signal, wherein (a) is performed by using a transfer function:

$$Mt(t)=GL(q)/[GL(q)+GNL(q)],$$

where GL(q) is the linear time domain characteristic of the speaker system; GNL(q) is the nonlinear time domain characteristic of the speaker system; and q is a delay operator.

8. The method according to claim 7, wherein the linear time domain characteristic GL(q) is generated by an ARX modeling or an ARMAX modeling, and the nonlinear time domain characteristic GNL(q) is generated by a nonlinear response measurement.

9. The method according to claim 7, wherein when an external error signal e(t) is input, in (a), the pre-corrected signal Z(t) is generated by using an equation:

$$Z(t)=Mt(t)x(t)-Me(t)e(t),$$

where x(t) is the audio signal from the audio source; Me(t) is the transfer function of the error signal, generated by using an equation Me(t)=JL(q)/[JL(q)+JNL(q)]; JL(q) is a linear time domain disturbance function of the speaker system; and JNL(q) is a nonlinear time domain disturbance function of the speaker system.

10. The method according to claim 7, wherein in (a), the audio signal is pre-corrected by using a finite impulse response (FIR) filter.

11. An apparatus for compensating for nonlinear distortion of a speakers system, the apparatus comprising:

a frequency domain converter which receives art audio signal from an audio source and converts the audio signal into a frequency domain signal;

a pre-corrector which pre-corrects the frequency domain signal by using a linear frequency characteristic and a nonlinear frequency characteristic of the speaker system; and a time domain converter which converts the pre-correcting signal into a time domain signal to generate the time domain signal of the audio signal, wherein a transfer function M(w) of the pre-corrector is generated by using an equation:

$$Mf(w)=[2HL(w)-HT(w)]/HL(w),$$

where HL(w) is the linear frequency characteristic of the speaker system; and HT(w) is the total frequency characteristic of the speaker system.

12. The apparatus according to claim 11, wherein the linear frequency characteristic HL(w) of the speaker system is generated by using an ARX modeling or an ARMAX modeling.

13. The apparatus according to claim 12, wherein the total frequency characteristic HT(w) of the speaker system is generated by using a nonlinear response measurement.

14. The apparatus according to claim 12, further comprising a digital-to-analog converter which converts the time domain signal into an analog signal.

15. The apparatus according to claim 12, wherein the frequency domain converter performs a fast Fourier transform, and the time domain converter performs an inverse fast Fourier transform.

16. The apparatus according to claim 12, wherein the pre-corrector comprises a finite impulse response (FIR) filter.

17. An apparatus for compensating for nonlinear distortion of a speaker system in a time domain, the apparatus comprising:

a time domain pre-corrector which pre-corrects an audio signal from an audio source by using a linear time domain characteristic and a nonlinear time domain characteristic of the speaker system; and a digital-to-analog converter which converts the pre-corrected signal into an analog signal, wherein a transfer function of the time domain pre-corrector is generated by using an equation:

$$Mt(t)=GL(q)/[GL(q)+GNL(q)],$$

where GL(q) is the linear time domain characteristic of the speaker system; GNL(q) is the nonlinear time domain characteristic of the speaker system; and q is a delay operator.

18. The apparatus according to claim 17, wherein the linear time domain characteristic GL(q) is generated by using an ARX modeling or an ARMAX modeling, and the nonlinear time domain characteristic GNL(q) is generated by using a nonlinear response measurement.

19. The apparatus according to claim 17, wherein when an external error signal e(t) is input to the time domain pre-corrector, the pre-corrected signal Z(t) is generated by using an equation:

$$Z(t)=Mt(t)x(t)-Me(t)e(t),$$

where x(t) is the audio signal from the audio source; Me(t) is the transfer function of the error signal, generated by using the equation Me(t)=JL(q)/[JL(q)+JNL(q)]; JL(q) is a linear time domain disturbance function of the speaker system; and JNL(q) is a nonlinear time domain disturbance function of the speaker system.

20. The apparatus according to claim 17, wherein the time domain pre-corrector comprises a finite impulse response (FIR) filter.

* * * * *